US007639222B2

(12) United States Patent
Chen et al.

(10) Patent No.: US 7,639,222 B2
(45) Date of Patent: Dec. 29, 2009

(54) FLAT PANEL DISPLAY, IMAGE CORRECTION CIRCUIT AND METHOD OF THE SAME

(75) Inventors: Yi-Cheng Chen, Changhua County (TW); Hsin-Chung Huang, Taipei County (TW); Hung-Shiang Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 542 days.

(21) Appl. No.: 11/163,088

(22) Filed: Oct. 4, 2005

(65) Prior Publication Data

US 2007/0075957 A1 Apr. 5, 2007

(51) Int. Cl.
*G09G 3/36* (2006.01)

(52) U.S. Cl. ..... 345/87; 345/89; 345/98; 345/101

(58) Field of Classification Search ..... 345/87–103, 345/204

See application file for complete search history.

(56) References Cited

U.S. PATENT DOCUMENTS

| | | | | |
|---|---|---|---|---|
| 6,806,871 | B1 * | 10/2004 | Yasue | 345/211 |
| 7,106,287 | B2 * | 9/2006 | Ham | 345/89 |
| 2003/0067435 | A1 * | 4/2003 | Liu | 345/101 |
| 2006/0092110 | A1 * | 5/2006 | Park | 345/87 |
| 2006/0139296 | A1 * | 6/2006 | Naiki et al. | 345/101 |
| 2006/0164355 | A1 * | 7/2006 | Kim et al. | 345/89 |
| 2007/0262972 | A1 * | 11/2007 | Nakata | 345/204 |

FOREIGN PATENT DOCUMENTS

| | | |
|---|---|---|
| JP | 62034133 | 2/1987 |
| JP | 2001-028697 | 1/2001 |
| JP | 2002041004 | 2/2002 |
| JP | 2002366112 | 12/2002 |
| TW | 511066 | 11/2002 |

* cited by examiner

*Primary Examiner*—Amare Mengistu
*Assistant Examiner*—Hong Zhou
(74) *Attorney, Agent, or Firm*—Jianq Chyun IP Office

(57) ABSTRACT

A flat panel display, an image correction circuit and method thereof are provided. The image correction circuit mainly includes a digital to analog conversion unit and a data processing unit. The digital to analog conversion unit includes a temperature sensor and a gamma voltage generator. The gamma voltage generator is adopted for generating a plurality of gamma voltages, and the temperature sensor is electrically connected to the gamma voltage generator and adopted for sensing the working temperature of the gamma voltage generator. The data processing unit is electrically connected to the digital to analog conversion unit. When the working temperature of the gamma voltage generator changes to higher (or lower) than the room temperature, the data processing unit selects and outputs applicable digital data to the digital to analog conversion unit. Therefore, the digital to analog conversion unit outputs a predetermined gamma voltage at room temperature according to the digital data.

7 Claims, 4 Drawing Sheets

FLAT PANEL DISPLAY, IMAGE CORRECTION CIRCUIT AND METHOD OF THE SAME

BACKGROUND OF THE INVENTION

1. Field of the Invention

The present invention generally relates to an image correction circuit and method. More particularly, the present invention relates to a flat panel display and the image correction circuit and method of the same.

2. Description of Related Art

As the multi-media technology advances, the requirement of display device increases day by day. Therefore, manufacturers in this field have spent a lot of efforts to develop display devices. Conventionally, due to its high display quality and well-developed technology, cathode ray tube (CRT) display has been dominated the market. In recent years, however, liquid crystal display (LCD) has been gradually accepted by users because of the advantages of light weight, thin thickness, high definition, small size, low power consumption and radiation free. Therefore, LCD gradually replaces the conventional CRT display and becomes the main stream of display device in the market of display device.

In general, the LCD shows images by using specific driving voltages to control tilt angles of liquid crystal molecules, wherein the value of driving voltages are decided by corresponding image signal (e.g., digital signal). However, the relationship between image signals (or the value of the driving voltage) and the tilt angles of the liquid crystal (or even the transmittance of the pixel) is not linear. Therefore, a gamma correction circuit is required for adjusting the driving voltage generated from the image signals so that the relationship between the driving voltage generated from the image signals and tilt angles of the liquid crystal (or even the transmittance of the pixel) can be linear.

At present, gamma voltages of display device are provided by using resistor stream to divide reference voltages. In a conventional LCD, the resister stream is generally disposed in a printed circuit board (PCB) outside the display device. However, in the new generation electronic products such as driving chip of mobile phones or dynamic gamma correction system, the resister stream for generating the gamma voltage is disposed in digital to analog conversion circuit. In addition, the resister stream is built in the integrated circuits of the digital to analog conversion circuit.

FIG. 1 is a circuit block diagram of a conventional gamma voltage generator. Referring to FIG. 1, a gamma voltage generator 100 mainly includes a resister stream 102, a plurality of selectors 104 and a voltage dividing unit 16. The resister stream 102 is constructed by a plurality of resistors connected in series. In addition, the resister stream 102 may be built in an integrated circuit (not shown). The selector 104 is connected between the resister stream 102 and the voltage dividing unit 106. The selector 104 may be, for example, controlled, by using a 3 bit control code. Therefore, each selector 104 can output 8 different voltage values.

Referring to FIG. 1, in a conventional 64 level LCD, for example, each selector 104 can output voltages $V_0$, $V_1$, $V_8$, $V_{20}$, $V_{43}$, $V_{55}$, $V_{62}$ and $V_{63}$ to a voltage dividing unit 106 with reference of the resister stream 102 according to the stored control code. In addition, the voltage dividing unit 106 can generate all the 64 gamma voltages $V_0, V_1, V_2, V_3, \ldots, V_8, V_9, V_{10}, \ldots, V_{20}, V_{21}, \ldots, V_{55}, V_{56}, V_{57}, \ldots, V_{62}$ and $V_{63}$ by dividing received voltages.

Use a 256 level LCD for example, voltage difference between each level is about 20 mV. However, the voltage difference between each level of a 1024 level LCD will be further smaller. Therefore, it is very important to stabilize the gamma voltage of the LCD in order to maintain the image quality of the LCD.

However, when an integrated circuit is operated under a high temperature circumstance or is operated for a long time that the working temperature increases, resistance of each resistor of the resister stream 102 built in the integrated circuit may be shifted. As a result, the gamma voltages outputted from the gamma voltage generator 100 at high temperature may be different from the predetermined gamma voltages at room temperature that image quality of the LCD becomes poor.

SUMMARY OF THE INVENTION

Therefore, one object of the present invention is to provide an image correction circuit of a flat panel display, wherein the level of the image outputted from the flat panel display will not be changed with the working temperature of the flat panel display.

In addition, another object of the present invention is to provide a flat panel display, wherein level of the image outputted from the flat panel display maintains stable even though the working temperature of the flat panel display changes.

Moreover, another object of the present invention is to provide an image correction method for a flat panel display, wherein the level of the image outputted from the flat panel display will be stable even though the working temperature of the flat panel display changes.

The present invention provides an image correction circuit of a flat panel display. The image correction circuit of a flat panel display comprises a digital to analog conversion unit and a data processing unit. The digital to analog conversion unit comprises a temperature sensor and a gamma voltage generator. The gamma voltage generator is to generate a plurality of gamma voltages. The temperature sensor is electrically connected to the gamma voltage generator to sense the working temperature of the gamma voltage generator.

Accordingly, the data processing unit is electrically connected to the digital to analog conversion unit and adopted for outputting a plurality of digital data to the digital to analog conversion unit according to the working temperature sensed by the temperature sensor. The digital to analog conversion unit outputs the corresponding gamma voltages according to the digital data.

According to one embodiment of the present invention, a flat panel display comprising a displaying panel, a display driver unit, a timing controller, a digital to analog conversion unit and a data processing unit is provided. The display driver unit is electrically connected to the displaying panel, the timing controller is electrically connected to the display driver unit and may be adopted for driving the display driver unit. In addition, the digital to analog conversion unit is electrically connected to the display driver unit. The digital to analog conversion unit and the data processing unit are the same as the digital to analog conversion unit and the data processing unit described above. The digital to analog conversion unit is used for outputting the gamma voltages to the flat panel display driver unit.

In one embodiment of the present invention, the data processing unit may comprise a dynamic gamma correction (DGC) unit, a first register and a second register. The first register and the second register are for example the read only memory. The DGC unit is to receive and analyze the image signals input to the flat panel display, for example. Further, the DGC unit generates an applicable gamma characteristic curve according to analysis result. The gamma voltages output by the data processing unit are corresponding to the gamma characteristic curve. The first register is adopted for storing a plurality of first control codes, and the first control codes correspond to one of the gamma voltages, respectively. In addition, the second register is adopted for storing a plurality of second control codes, and the second control codes also correspond to one of the gamma voltages, respectively.

Accordingly, the digital to analog conversion unit may be electrically connected to either the first register or the second register to receive the first control codes or the second control codes according to the working temperature sensed by the temperature sensor. One of the gamma voltages is output according to the first control codes or the second control codes received.

In the embodiment of the present invention, the data processing unit can include a switch controller, electrically connected between the digital to analog conversion unit and the first and second registers. The switch controller is used to electrically connect the digital to analog conversion unit with the first register or electrically connect the digital to analog conversion unit with the second register, selectively.

In one embodiment of the present invention, the flat panel display may comprise a liquid crystal displaying panel.

In the embodiment of the present invention, the display driver unit includes, for example, a scan line driver and a data line driver. The scan line driver and the data line driver are respectively electrically connected to the displaying panel.

According to one embodiment of the present invention, an image correction method for a flat panel display is provided. First, an image data is received. Then, the image data is analyzed to generate a gamma characteristic curve. Next, a plurality of first control codes and a plurality second control codes are generated and stored, wherein the first control codes and the second control codes correspond to a plurality of gamma voltages respectively. Further, the first control codes or the second control codes are selected and one of the gamma voltages is output according to the selected first control codes or the second control codes.

In one embodiment of the present invention, before the first control codes or the second control codes are selected further comprises a step of sensing a working temperature. In the embodiment, the image correction method selects either the first control codes or the second control codes according to the working temperature.

Accordingly, in the present invention, the digital data for outputting the gamma voltages is adjusted according to change of the working temperature so that the gamma voltages of a same image data received will be stable at different temperatures. Therefore, the level of the image displayed by the flat panel display of the present invention is not influenced by the working temperature and thus has a stable image quality.

One or part or all of these and other features and advantages of the present invention will become readily apparent to those skilled in this art from the following description wherein there is shown and described in one embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention.

DESCRIPTION OF EMBODIMENTS

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In the image correction circuit of the flat panel display of the present invention, a temperature sensor is provided for sensing working temperature of the gamma voltage generator. Therefore, voltages corresponding to the control codes may be corrected according to change of the working temperature of the gamma voltage generator so that level of the image of the flat panel display will not be influenced by change of the working temperature.

Figure 2:
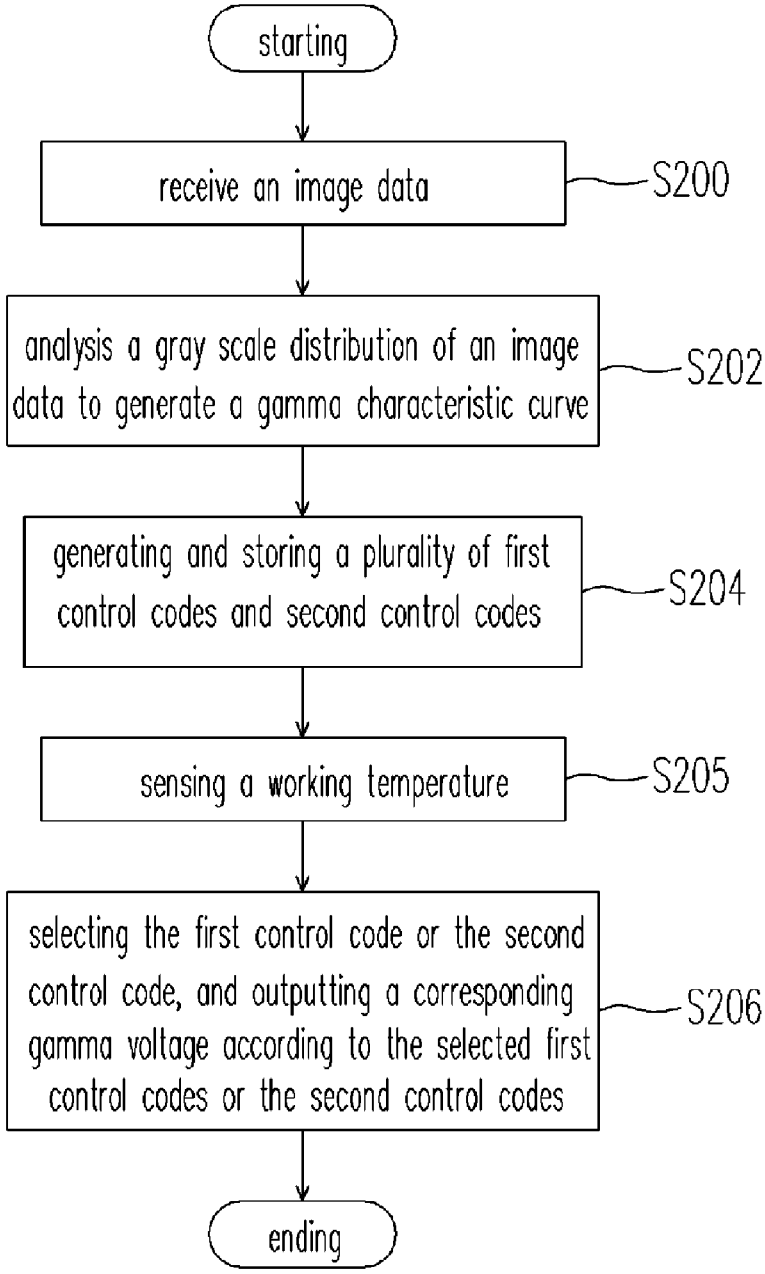
FIG. 2 is a process flowchart of an image correction method for a flat panel display according to one embodiment of the present invention.

FIG. 2 is a process flowchart of an image correction method of a flat panel display according to one embodiment of the present invention. Referring to FIG. 2, in step S200, an image data is received. Then, in step S202, gray scale distribution of the image data received in the step S200 is analyzed to generate a specific gamma characteristic curve. In step S204, a plurality of first control codes and second control codes are generated and stored. Wherein, each of the first control codes and the second control codes corresponds to a gamma voltage respectively and the gamma voltage corresponds to the gamma characteristic curve generated in the step S202. Next, in step S206, the first control code or the second control code is selected, and a corresponding gamma voltage is output by the selected first control code or the second control code. Therefore, a frame is displayed according to the image data received in the step S200.

Referring to FIG. 2, noting that in one embodiment of the present invention, step S205 may be further performed to sense a working temperature before performing step S206. Then, in step S206, the first control code or the second control code may be selected according to the working temperature sensed in step S205. For example, if the temperature sensed in step S205 is close to a room temperature, step 206 will select the first control code and the gamma voltage will be output according to the first control code. In reverse, if the temperature sensed in step S205 is higher or lower than the room temperature, the second control code will be selected in step S206 and the gamma voltage is output according to the second control code.

Accordingly, in the image correction method of the present invention, the control code corresponding to the gamma voltage is selected according to change of the working temperature so that the gamma voltage of the flat panel display will be stably output at different working temperatures. Hereinafter, some embodiments of a circuit of a flat panel display for performing the image correction method will be described in detail to those skilled in the art; however, these embodiments can not be used to limit the scope of the present invention.

Figure 3:
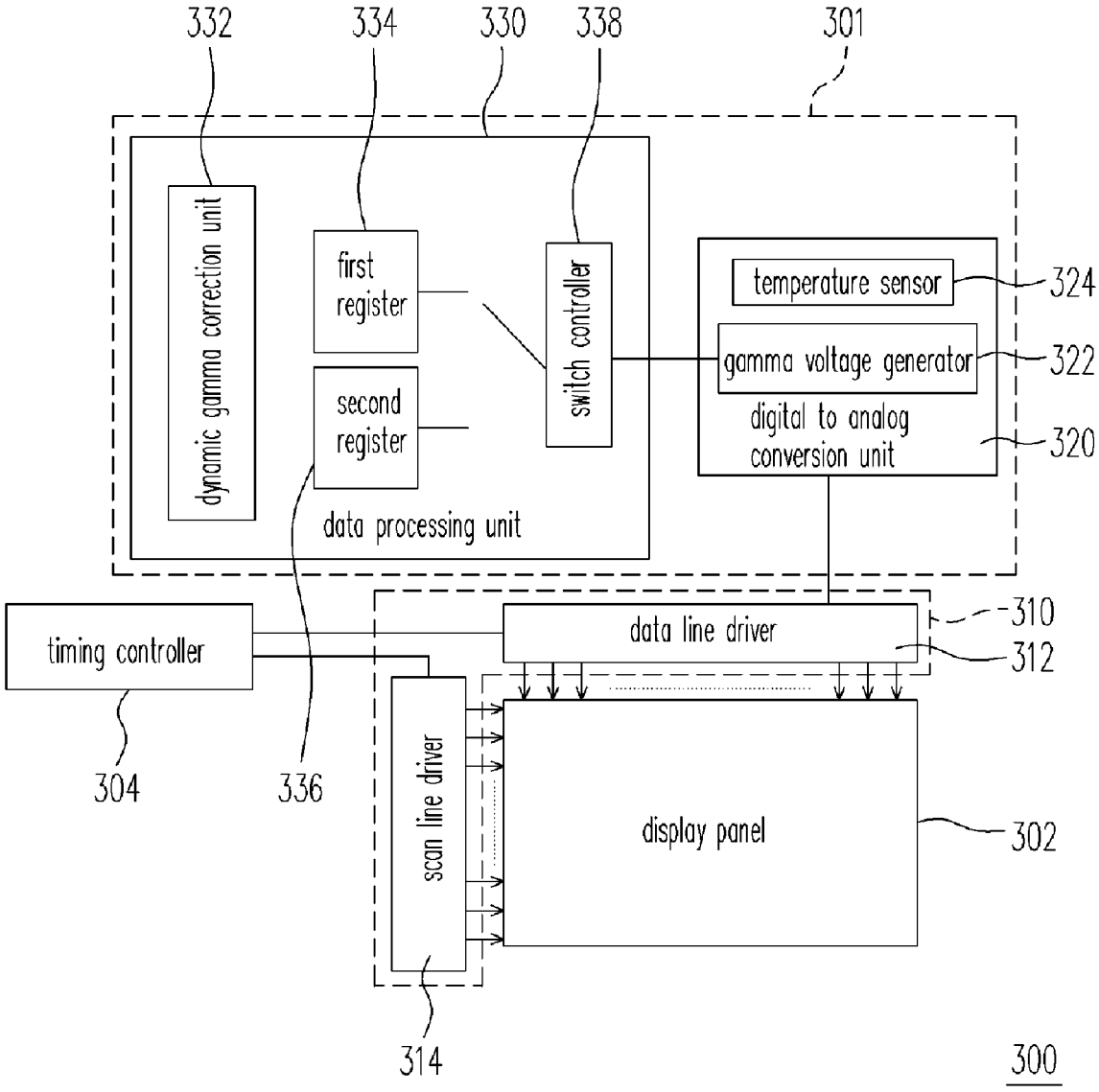
FIG. 3 is a circuit block diagram of a flat panel display according to one embodiment of the present invention.

FIG. 3 is a circuit block diagram of a flat panel display according to one embodiment of the present invention. Referring to FIG. 3, a flat panel display 300 may comprise a displaying panel 302, a display driver unit 310, a timing controller 304, a digital to analog conversion unit 320 and a data processing unit 330. The displaying panel 302 comprises, for example, a liquid crystal displaying panel. The display driver unit 310 is electrically connected to the displaying panel 302. In addition, the display driver unit 310 comprises, for example, a data line driver 312 and a scan line driver 314. The timing controller 304 is electrically connected to the data line driver 312 and the scan line driver 314.

Accordingly, the scan line driver 314 is provided for driving each scan line (not shown) of the liquid crystal displaying panel 302 according to a control signal output from the timing controller 304. Then, the gamma voltages output from the digital to analog conversion unit 320 may be output to each data line (not shown) of the displaying panel 302 via the data line driver 312 according to the control signal output from the timing controller 304 to display an image on the displaying panel 302.

Figure 1:
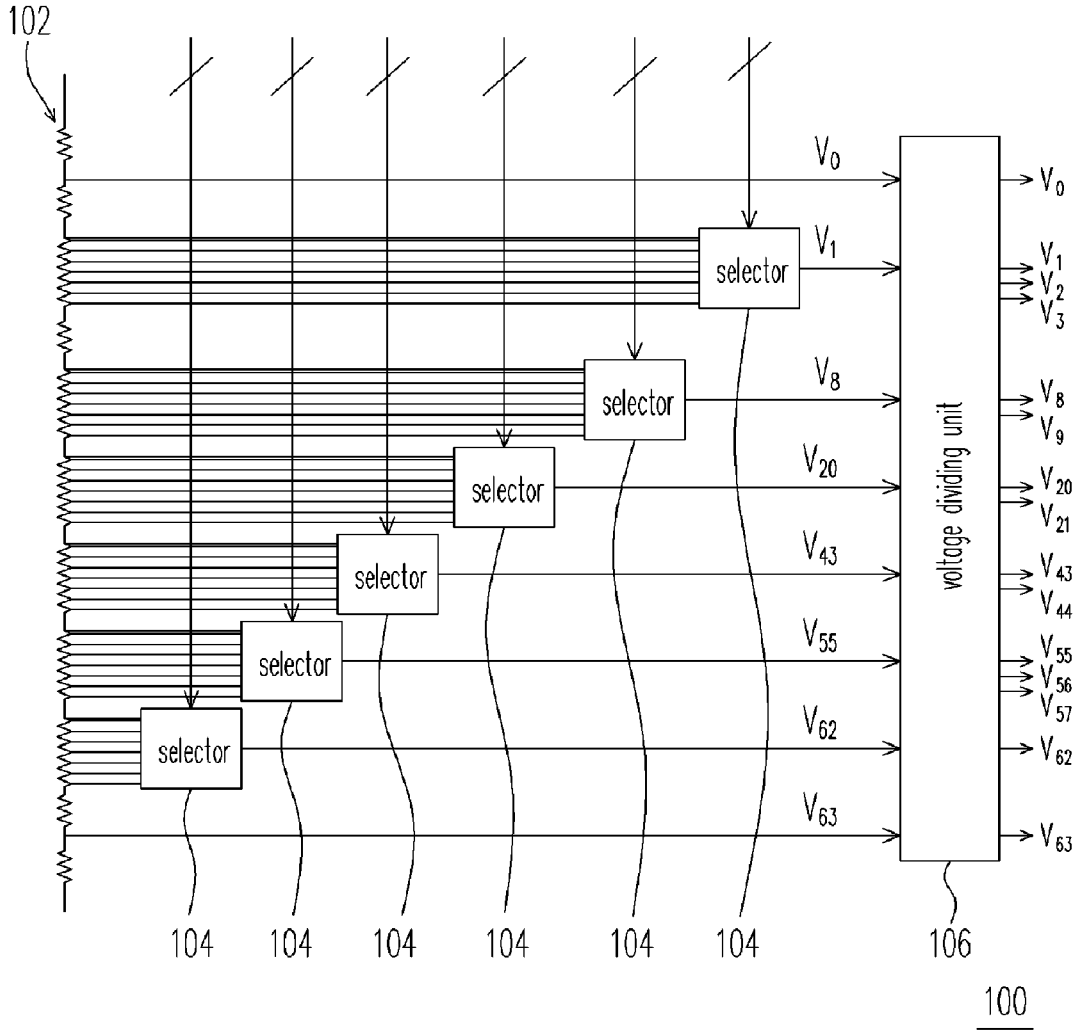
FIG. 1 (PRIOR ART)
FIG. 1 is a circuit block diagram of a conventional gamma voltage generator.

Referring to FIG. 3, the digital to analog conversion unit 320 and the data processing unit 330 are the image correction circuit 301 of the flat panel display 300. The digital to analog conversion unit 320 is electrically connected to the display driver unit 310, and the digital to analog conversion unit 320 mainly comprises the gamma voltage generator 322 and the temperature sensor 324. The gamma voltage generator 322 is, for example, similar to the gamma voltage generator 100 shown in FIG. 1. In addition, the temperature sensor 324 is electrically connected to the gamma voltage generator 322 for sensing the working temperature of the gamma voltage generator 322. In more detail, the temperature sensor 324 may be provided for sensing the working temperature of the resister stream inside the gamma voltage generator 322 so that change of the resistance of the resister stream can be calculated according to the working temperature sensed by the temperature sensor 324.

In addition, the data processing unit 330 is electrically connected to the digital to analog conversion unit 320 and adapted for outputting a plurality of digital data to the digital to analog conversion unit 320. The data processing unit 330 may comprise, for example, a dynamic gamma correction unit 332, a first register 334 and a second register 336. The first register 334 and the second register 336 can be, for example, read only memory.

After the image data is input to the data processing unit 330, the dynamic gamma correction unit 332 analyzes level of the image data and then generates a gamma characteristic curve according to analyzed result. Therefore, the gamma voltages output from the gamma voltage generator 322 are corresponding to the gamma characteristic curve. Accordingly, the gamma characteristic curve is adjusted by the data processing unit 330 according to the level distribution condition of each image data so that the image being too black or too white can be adjusted to achieve a better contrast. Thus, the image quality of the display is improved.

Next, referring to FIG. 3, after the sensed temperature is fed back to the data processing unit 330 from the digital to analog conversion unit 320, the data processing unit 330 outputs a digital data to the digital to analog conversion unit 320 according to the temperature sensed by the temperature sensor 324. In more detail, the data processing unit 330 outputs the digital data to a plurality of selectors (e.g., as the selectors 104 shown in FIG. 1) of the gamma voltage generator 322 respectively so that the gamma voltage generator 322 outputs the gamma voltage according to the digital data.

Accordingly, the digital data output from the data processing unit 330 may be, for example, a plurality of first control codes stored in the first register 334 and a plurality of second control codes stored in the second register 336. In one preferred embodiment of the present invention, when the sensed temperature is close to room temperature, the data processing unit 330 outputs the first control code to the digital to analog conversion unit 320. Contrarily, when the working temperature of the gamma voltage generator 322 is changed (e.g., higher than the room temperature), the data processing unit 330 outputs the second control code to the digital to analog conversion unit 320. The data processing unit 330 selects the first control code or the second control code for outputting by a switch controller 338. That is, the data processing unit 330 is electrically connected to the digital to analog conversion unit 320 via the switch controller 338. In addition, at room temperature, the switch controller 338 is electrically connected between the first register 334 and the digital to analog conversion unit 320 to output the first control code to the digital to analog conversion 320. When the signal fed back from the temperature sensor 324 to the switch controller 338 shows a change of the working temperature of the gamma voltage generator 332, the switch controller 338 is switched to electrically connect between the second register 336 and the digital to analog conversion unit 320 to output the second control code to the digital to analog conversion unit 320.

Figure 4:
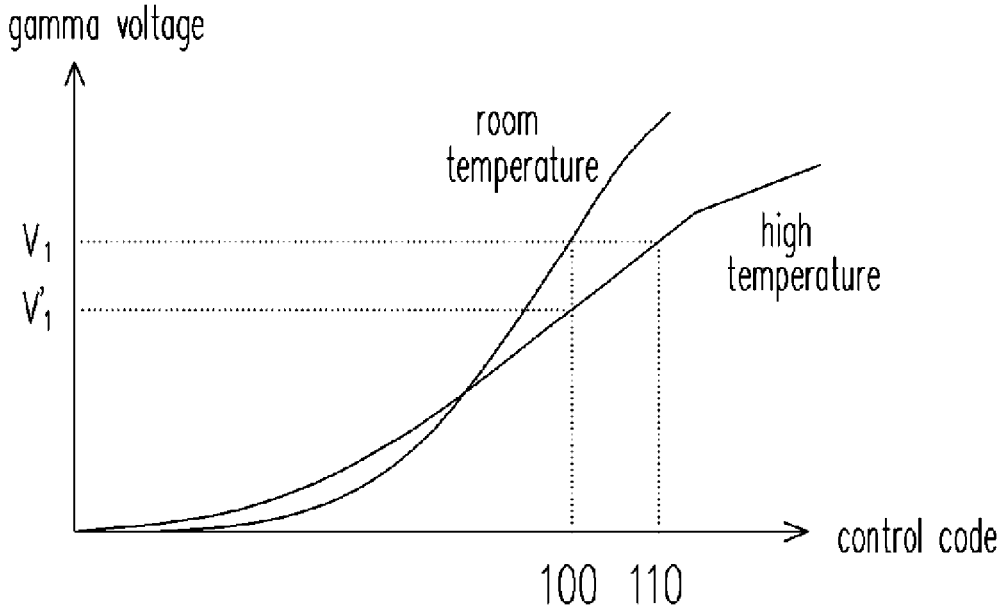
FIG. 4 is a curve diagram of a relationship between the first control code and the corresponding voltage value at room temperature and higher temperature.

In more detail, the gamma voltage corresponding to the first control code is a predetermined voltage value output at room temperature. However, resistance of the resister stream of the gamma voltage generator 322 may change with the working temperature. Therefore, when the working temperature of the gamma voltage generator 322 changes, the gamma voltage corresponding to the first control code is no more the original predetermined voltage output at room temperature. FIG. 4 is a curve diagram of a relationship between the first control code and the corresponding voltage value at room temperature and higher temperature. Referring to FIG. 4, assuming that the first control code and the second control code are in a 3-bit control code, under room temperature, the first control code "100" corresponds to a gamma voltage $V_1$. When the working temperature of the gamma voltage generator 322 changes, the first control code "100" corresponds to a gamma voltage $V_1'$.

Referring to FIG. 3 again, the data processing unit 330 selects to output the second control code stored in the second register 336. The gamma voltage corresponding to the second control codes at non-room temperature is the same as the predetermined voltage value at room temperature. In other words, when the working temperature of the gamma voltage generator 322 changes, the data processing unit 330 outputs the second control code to the selector of the gamma voltage generator 322 so that the voltage value selected is the same as the voltage value selected by the first control code at room temperature. For example, at a working temperature higher than the room temperature, the data processing unit 330 outputs, for example, a second control code "110" corresponding to the gamma voltage $V_1$ as shown in FIG. 4.

In summary, a temperature sensor is provided for sensing the temperature of the resister stream for generating the gamma voltage built in the integrated circuits. Therefore, even though the resistance of the resister stream shifts with the temperature, the digital data corresponding to the gamma voltage of the present invention can be corrected according to the sensed temperature to output a predetermined gamma voltage at room temperature. In other words, in the present invention, the digital data for outputting the gamma voltage is adjusted according to change of the working temperature so that the gamma voltage of a same image data received may be stable at different temperature. Accordingly, the level of the frame displayed by the flat panel display of the present invention is not influenced by the working temperature and thus has a stable image quality.

The foregoing description of the embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An image correction circuit of a fiat panel display, comprising:

a digital to analog conversion unit, comprising:

a gamma voltage generator having a resistance stream and a plurality of selectors coupled to the resistance stream for generating a plurality of gamma voltages according to a digital data; and a temperature sensor electrically connected to the gamma voltage generator for sensing a working temperature of the resistance stream of the gamma voltage generator; and a data processing unit electrically connected to the digital to analog conversion unit, and the data processing unit outputs the digital data, comprising a plurality of first control codes and a plurality of second control codes, to the digital to analog conversion unit according to the working temperature sensed by the temperature sensor, and the data processing unit comprising:

a dynamic gamma correction unit for receiving an image data and analyzing a gray scale distribution of the image data so as to generate a gamma characteristic curve, wherein the gamma voltages are corresponding to the gamma characteristic curve;

a first register, wherein the first control codes are stored in the first register, and each of the first control codes is corresponding to one of the gamma voltages;

a second register, wherein the second control codes are stored in the second register, and each of the second control codes is corresponding to one of the gamma voltages and mapping to one of the first control codes, wherein the digital to analog conversion unit is selectively electrically connected to the first register or the second register to receive the first control code or the second control code according to the working temperature sensed by the temperature sensor, and one of the gamma voltages is output according to the first control code or the second control code received; and a switch controller, electrically connected between the digital to analog conversion unit and the first and second registers, in selection for electrically connecting the digital to analog conversion unit with the first register or electrically connecting the digital to analog conversion unit with the second register.

2. The image correction circuit of claim 1, wherein the first register and the second register are respectively read only memories.

3. A flat panel display, comprising:

a displaying panel;

a display driver unit electrically connected to the displaying panel;

a timing controller electrically connected to the display driver unit for driving the display driver unit;

a digital to analog conversion unit electrically connected to the display driver unit, the digital to analog conversion unit comprising:

a gamma voltage generator having a resistance stream and a plurality of selectors coupled to the resistance stream for generating a plurality of gamma voltages according to a digital data; and a temperature sensor electrically connected to the gamma voltage generator for sensing a working temperature of the resistance stream of the gamma voltage generator; and a data processing unit electrically connected to the digital to analog conversion unit, and the data processing unit outputs the digital data, comprising a plurality of first control codes and a plurality of second control codes, to the digital to analog conversion unit according to the working temperature sensed by the temperature sensor, and the data processing unit comprising:

a dynamic gamma correction unit for receiving an image data and analyzing a gray scale distribution of the image data so as to generate a gamma characteristic curve, wherein the gamma voltages are corresponding to the gamma characteristic curve;

a first register, wherein the first control codes are stored in the first register, and each of the first control codes is corresponding to one of the gamma voltages;

a second register, wherein the second control codes are stored in the second register, and each of the second control codes is corresponding to one of the gamma voltages and mapping to one of the first control codes, wherein the digital to analog conversion unit is selectively electrically connected to the first register or the second register to receive the first control code or the second control code according to the working temperature sensed by the temperature sensor, and one of the gamma voltages is output according to the first control code or the second control code received; and a switch controller, electrically connected between the digital to analog conversion unit and the first and second registers, in selection for electrically connecting the digital to analog conversion unit with the first register or electrically connecting the digital to analog conversion unit with the second register.

4. The flat panel display of claim of claim 3, wherein the first register and the second register are respectively read only memories.

5. The flat panel display of claim 3, wherein the displaying panel comprises a liquid crystal displaying panel.

6. The flat panel display of claim 3, wherein the display driver unit includes a scan line driver and a data line driver, respectively electrically connected to the displaying panel.

7. An image correction method for a fiat panel display, comprising:

providing a resistance stream and a plurality of selectors coupled to the resistance stream for generating a plurality of gamma voltages;

receiving an image data;

analyzing a gray scale distribution of the image data to generate a gamma characteristic curve;

generating and storing a plurality of first control codes and a plurality of second control codes, wherein each of the first control codes or the second control codes are corresponding to one of the gamma voltages respectively, and each of the first control codes is mapping to one of the second control codes; and sensing a working temperature of the resistance stream and accordingly selecting the first control codes or the second control codes for the selector for generating the corresponding gamma voltage, and outputting one of the gamma voltages according to the first control codes or the second control codes being selected.

* * * * *